US005347259A

United States Patent [19]

Jongewaard

[11] Patent Number: 5,347,259

[45] Date of Patent: Sep. 13, 1994

[54] STROBE WARNING LIGHT

[75] Inventor: Mark P. Jongewaard, Arvada, Colo.

[73] Assignee: Wheelock, Inc., Long Branch, N.J.

[21] Appl. No.: 31,949

[22] Filed: Mar. 16, 1993

[51] Int. Cl.[5] ..... G08B 5/00

[52] U.S. Cl. ..... 340/331; 362/35; 362/170; 362/297

[58] Field of Search ..... 340/331, 471, 472, 473; 362/35, 120, 297, 298; 350/97, 99–103

[56] References Cited

U.S. PATENT DOCUMENTS

| | | | |
|---|---|---|---|
| 3,764,799 | 10/1973 | Schulz | 340/472 |
| 3,930,227 | 12/1975 | Gof | 340/473 |
| 4,104,614 | 8/1978 | Litman | 340/472 |
| 4,224,599 | 9/1980 | Peirish | 340/473 |
| 4,377,802 | 3/1983 | Ferenc | 340/472 |
| 4,931,768 | 6/1990 | Jincks et al. | 340/473 |
| 5,057,985 | 10/1991 | Kreutzer | 340/471 |
| 5,207,496 | 5/1993 | Stanuch et al. | 340/471 |

*Primary Examiner*—John K. Peng

*Assistant Examiner*—Nina Tung

*Attorney, Agent, or Firm*—Brumbaugh, Graves, Donohue & Raymond

[57] ABSTRACT

A strobe warning light comprises an elongated strobe lamp having a longitudinal axis, a lamp support supporting the lamp in a predetermined position, and a reflector on the support that includes a first surface positioned on one side of a first reference plane that includes the lamp axis and a second surface spaced apart axially of the lamp from the first surface and positioned on the other side of the first reference plane. The first and second surfaces face generally toward each other and are configured and oriented to receive light from the lamp and reflect it in opposite directions along paths generally parallel to the lamp axis and on opposite sides of the first reference plane so that each one of the first and second surfaces directs reflected light predominantly past the other of the first and second surfaces. The reflector also has a third surface that is configured and oriented to reflect light from the lamp in divergent directions generally radially with respect to the lamp axis.

12 Claims, 4 Drawing Sheets

STROBE WARNING LIGHT

BACKGROUND OF THE INVENTION

Regulations relating to fire safety have become more stringent in recent years. For example, one aspect of relatively new Federal Regulations relating to handicapped persons is the requirement for visual fire warning systems for the hearing-impaired in various types of public spaces. Visual alarms using strobe lamps are well-known and in widespread use, primarily in industrial and vehicular settings. They will in the future be more frequently installed in public spaces in institutional and commercial buildings, not only when required but as a preferred safety practice.

Strobe lamps are elongated tubes. As such, the light they produce is not uniform in all directions. FIG. 7 of the accompanying drawings shows the light output of a bare strobe lamp (no reflector or lens) at angles in a plane perpendicular to the lamp axis relative to a line in that plane (curve 1) and at angles in a plane that includes the lamp axis relative to a line in that plane perpendicular to the lamp axis (curve 2). The light that radiates perpendicularly from the lamp relative to its axis (curve 1) is of uniform intensity. However, the light output in the plane of the lamp axis (curve 2) diminishes substantially as a function of the cosine of the angle between the radial line in the plane and all other lines. Near and at + and −90°, i.e. when the lamp is observed from either end, the light output is but a small fraction of its output in the radial direction.

Underwriters Laboratories (UL®) has recently adopted standards that require certain levels of light output from strobe alarm lights for fire safety warning systems in (1) a plane perpendicular to the lamp axis and (2) the plane that is perpendicular to that plane and includes the lamp axis. (Throughout this specification, the term "light" refers to a system that consists of a strobe lamp bulb, a support that may include a reflector, and a lens, and the term "lamp" refers to the light-emitting strobe light bulb element.) Curve 3 in FIG. 7 depicts the UL® requirement for plane 2 above. Meeting the requirement (not shown) for plane 1 above is not a problem, provided the lamp has the required intensity for its particular UL® rating. Meeting the requirement for plane 2 is a problem, as is apparent from FIG. 7; note that the light output (curve 2) for a bare lamp in plane 2 is below the UL® requirement at and near + and −90°.

One way of meeting the requirement is to equip the strobe light with two lamps, one perpendicular to the other. That way is costly and also requires more electric current, which for a given battery storage capacity reduces the operating time of the device or for a given operating time requires more battery storage capacity, another additional cost. Another possible way of meeting the UL® requirement for plane 2 is with a specially designed lens, but that means diverting light and thus requires reducing the light output in directions other than plane 2.

SUMMARY OF THE INVENTION

An object of the invention is to provide a strobe light, especially for fire safety warning systems, that provides enhanced light output at high angles from the radial in a plane the includes the lamp axis. Another object is to provide a strobe light having a high light output for a given lamp output and that meets the UL® requirements. Another object is to provide a strobe light of the type that is installed on a wall or ceiling and that has a high efficiency of lamp output utilization, thereby permitting the lamp current draw to be kept low for any given light output.

The foregoing objects are attained, according to the present invention, by a strobe warning light comprising an elongated strobe lamp having a longitudinal axis, a lamp support supporting the lamp in a predetermined position, and a reflector on the support having a first surface positioned on one side of a first reference plane that includes the lamp axis and a second surface spaced apart axially of the lamp from the first surface and positioned on the other side of the first reference plane. The first and second surfaces face generally toward each other and are configured and oriented to receive light from the lamp and reflect it in opposite directions along paths generally parallel to the lamp axis and on opposite sides of the first reference plane so that each one of the first and second surfaces directs reflected light predominantly past the other of the first and second surfaces.

In a strobe light, according to the invention, each of the first and second surfaces receives light from the lamp that emanates in directions that are at small angles to the first reference plane. The light from the lamp intercepted by the first and second surfaces is of sufficiently high intensity to exceed the UL® requirements when reflected in the predetermined direction. In particular, the first and second surfaces are configured and positioned to reflect the intercepted light at predetermined ranges of angles close to +90° and −90° from the radial line in the first reference plane and also to reflect the intercepted light along paths that are generally parallel to the first reference plane. The ranges of angles in the first reference plane, relative to the radial line in that plane, may be +70° to +90° and −70° to −90°. By "generally parallel," it is meant that the intercepted light is reflected within a few degrees, say five degrees plus or minus, to the first reference plane. Accordingly, the reflected light from the first and second reflector surfaces fills in the region of the output curve of a bare lamp (FIG. 7) near +90° and −90°.

It is preferable, though not essential, that the first and second surfaces both be located entirely on one side of a second reference plane that includes the lamp axis and is perpendicular to the first reference plane so that the first and second surfaces do not block light from the lamp directed along the second reference plane. If the first and second surfaces extend across the second reference plane, they are in the path of the light in that plane and will block some of the light. While the reflected light can partly make up for the blocked light that would otherwise pass directly, the preferred design avoids blocking light that should not be blocked. Moreover, in most installations of the strobe light, the invention makes use of light that would otherwise not be used effectively, if at all. In this regard, in installations of the strobe light on a wall or ceiling, the light from the lamp that is directed toward the wall is not used. In practice, this light is reflected by a reflector and is not lost. In the present invention, it is also reflected, but in a more beneficial direction.

In a preferred embodiment, the first and second surfaces are substantially identical and are located symmetrically with respect to the axial center of the lamp. Again this is not a necessary feature, but it is advantageous to have the lamp provide a generally symmetrical light output for universal use.

The preferred paths of reflected light from the first and second surfaces are obtained when the surfaces are concavely curved in directions parallel to the first reference plane and in directions parallel to the second reference plane (i.e., doubly concavely curved) such that they reflect light within predetermined angles with respect to the lamp axis in planes parallel to the first reference plane and within predetermined ranges of angles with respect to the lamp axis in planes parallel to the second reference plane.

It is, of course, highly advantageous for the reflector to have a third surface configured and oriented to reflect light from the lamp in divergent directions generally radially with respect to the lamp axis. The third surface may, for example, be a segment of a cylindrical surface, such as a circular cylindrical surface, that is concave with respect to the axis of the lamp and has its axis coincident with or substantially parallel to the axis of the lamp and should also be located entirely on one side of a second reference plane that includes the lamp axis and is perpendicular to the first reference plane so that it does not block light from the lamp directed along the second reference plane or in directions on the opposite side of the second reference plane from the reflector.

For a better understanding of the invention, reference may be made to the following description of an exemplary embodiment, taken in conjunction with the figures of the accompanying drawings.

DESCRIPTION OF THE EMBODIMENT

Figure 1:
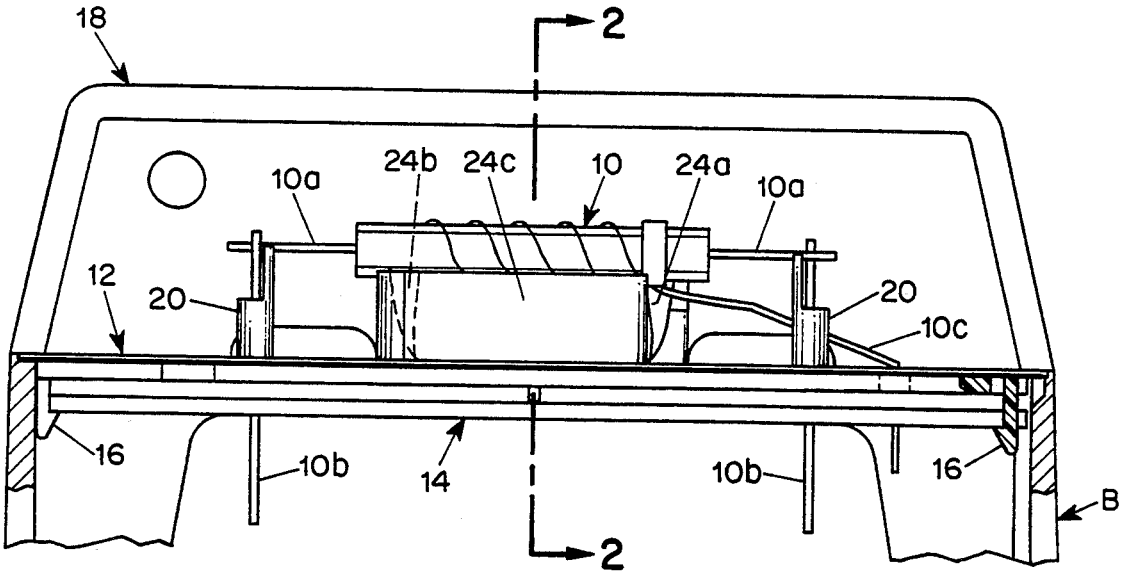
FIG. 1 is a side cross-sectional view of the embodiment, taken generally along a plane represented by the line 1—1 of FIG. 2.

The strobe light of FIG. 1, like conventional strobe lights, has a strobe lamp 10 (the light-emitting bulb element), which is mounted on and affixed to a support 12 in a predetermined position. The support 12, in turn, is attached to a printed circuit board 14, such as by lugs 16 that snap into slots in the board. The support and board are mounted on a base B, only part of which is shown and the details of which are a matter of routine design. A lens 18 fits over the lamp and the support.

The support 14 is injection-molded from a suitable polymeric material and is in the form of a thin elongated plate over most of its extent. A pair of lamp-supporting posts 20 extend out from one face and receive the lamp electrodes **10*a* in grooves in their upper surfaces. Holes in posts 20 receive the electrode leads 10*b* of the lamp, which protrude through the plate and are soldered to the solder side of the circuit board 14. The lead 10*c* from the trigger coil of the lamp passes through a hole 23** in the support.

The reflector 24, which embodies the present invention, is molded into and is thus integral with the support 14. It may, however, be a separate component and be suitably attached to the support. The reflector has a first surface **24*a* positioned on one side of a first reference plane, labelled "FRP" in FIG. 2, that includes the lamp axis and a second surface 24*b* that spaced apart axially of the lamp from the first surface and positioned on the other side of the first reference plane FRP (see FIG. 3). The first and second reflector surfaces face generally toward each other and are configured and oriented, as described below in more detail, to receive light from the lamp and reflect it in opposite directions along paths generally parallel to the lamp axis and on opposite sides of the first reference plane so that each one of the first and second surfaces directs reflected light predominantly past the other of the first and second surfaces. For convenience, the first and second surfaces 24*a* and 24*b*** of the reflector are referred to below as "wings."

Figure 2:
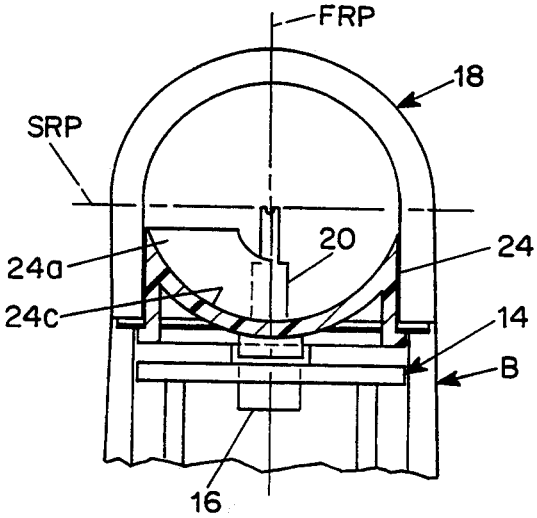
FIG. 2 is an end-cross-sectional view of the embodiment, taken generally along the lines 2—2 of FIG. 1.
Figure 4:
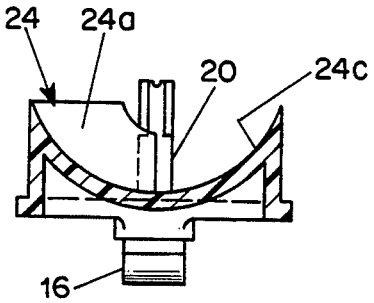
FIG. 4 is an end-cross-sectional view of the lamp support, also taken along the line 2—2 of FIG. 1.
Figure 3:
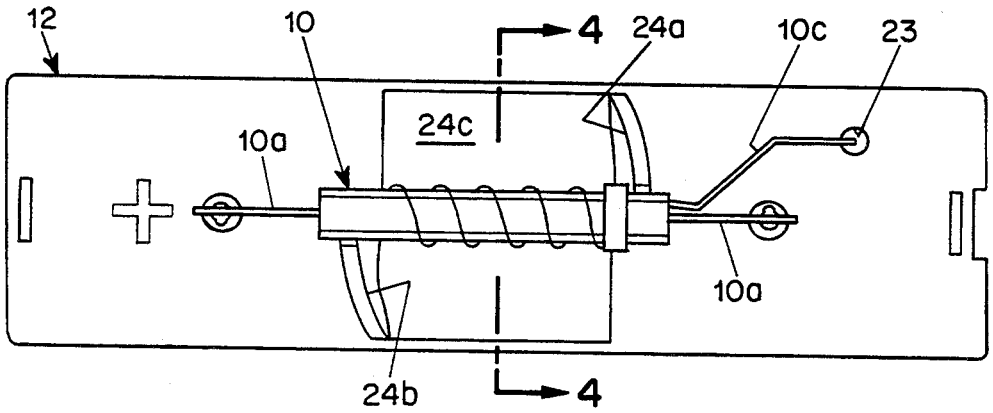
FIG. 3 is a top plan view of the lamp and the lamp support.
Figure 5:
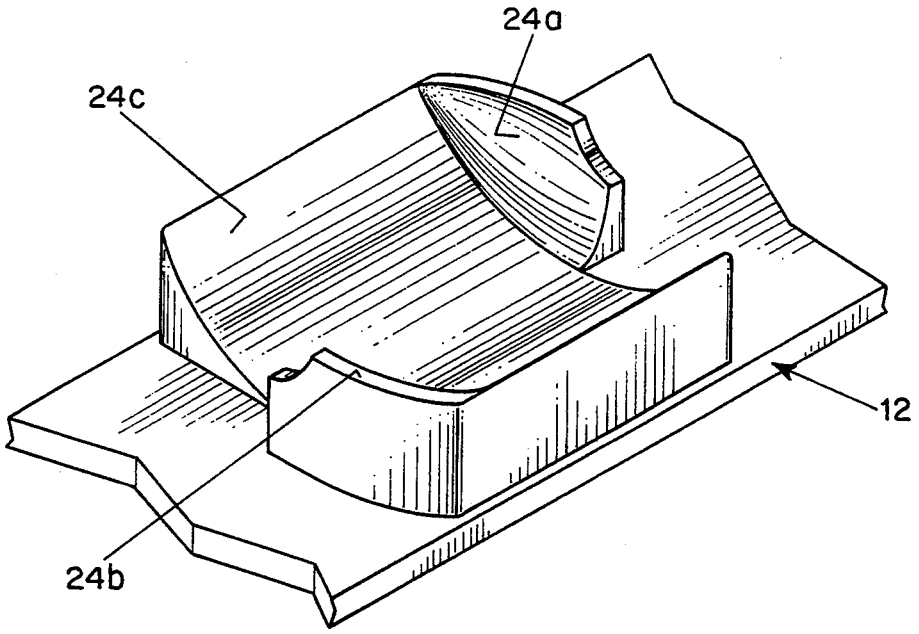
FIG. 5 is a pictorial view of the reflector portion of the lamp support.
Figure 9:
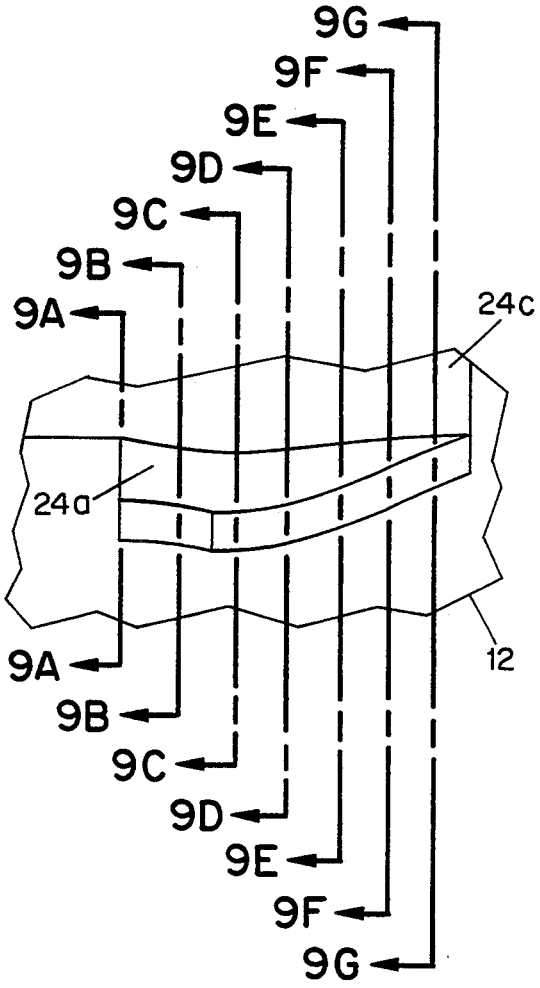
FIG. 9 is a fragmentary plan view of a portion of the reflector.

The wings **24*a* and 24*b* of the reflector are both located entirely on one side of a second reference plane, labelled "SRP" in FIG. 2**, that includes the lamp axis and is perpendicular to the first reference plane FRP so that the wings do not block light from the lamp directed along the second reference plane. In other words, the wings are positioned so that they leave at least $+90°$ and $-90°$ around the lamp with respect to the first reference plane unobstructed. The wings are identical and are located equidistant from the axial center of the lamp, thereby to provide a symmetrical light output for universal use.

Figure 6:
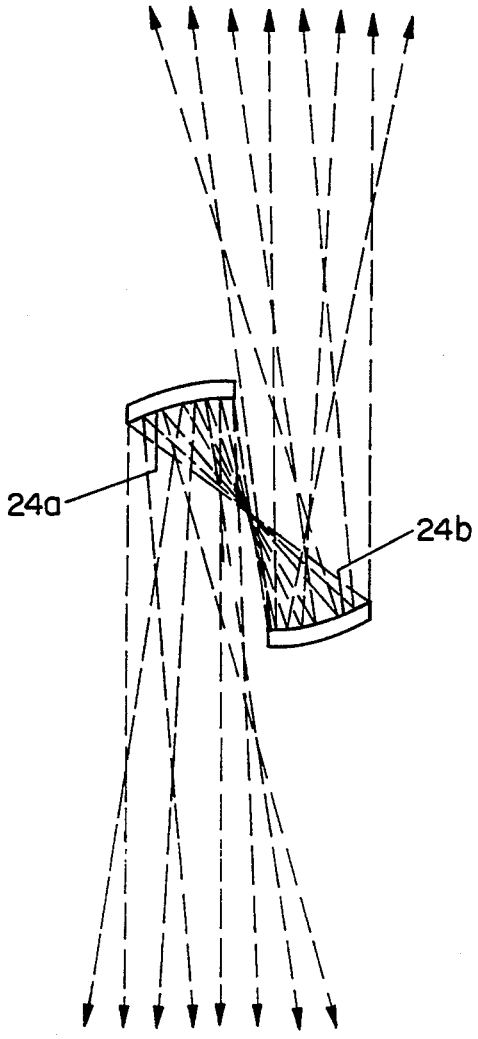
FIG. 6 is a diagram of the paths of the light intercepted and reflected by the first and second surfaces of the reflector.

The preferred paths of reflected light from the wings are obtained when the wings are concavely curved in directions parallel to the first reference plane and in directions parallel to the second reference plane (i.e., doubly concavely curved) such that they reflect light within predetermined angles with respect to the lamp axis in planes parallel to the first reference plane and within predetermined angles with respect to the lamp axis in planes parallel to the second reference plane. As shown in FIG. 6, which shows the light paths as viewed perpendicularly to the plane of the support 14, the reflected light from each of the wings forms a slightly divergent pattern. Most of the light reflected by each wing is directed along paths that are not blocked by the other wing. The curvatures of each wing in planes parallel to the first reference plane FRP direct the reflected light along a slightly divergent path that is generally centered on a line parallel to the lamp axis. FIGS. 9 and 9A to 9G show the profiles of the wings **24*a* and 24*b*** in detail, the sections being referenced to the centerline of the lamp by the lines RL and the junctures with the third reflector surface being indicated by the lines T.

The reflector has a third surface **24*c* configured and oriented to reflect light from the lamp in divergent directions generally radially with respect to the lamp axis. In particular the third surface 24*c*** is a segment of a cylindrical surface that is concave with respect to the axis of the lamp and has its axis coincident with or substantially parallel to the axis of the lamp. The surface 24c may be, but need not necessarily be, a circular cylindrical surface. It is located entirely on the same side of the second reference plane SRP as the wings 24a and 24b so that it does not block light from the lamp directed along the second reference plane or in directions on the opposite side of the second reference plane from the reflector. The wings are joined to the third surface 24c at diagonally opposite portions of its axial ends. The third surface of the reflector captures and reflects nearly all the light that would otherwise be directed toward a wall or ceiling on which the light is mounted through close to a +90° to −90° range of angles with respect to the first reference plane, thereby efficiently using the lamp output in the radial direction. The surface 24c shifts curve 1 of FIG. 7 to nearly double the output level of a bare lamp.

The surfaces of the reflector are, of course, coated with a reflective material. In addition, all other surfaces of the support that face the lens also have the reflective coating in order to reflect as much light as possible toward the lens.

Figure 7:
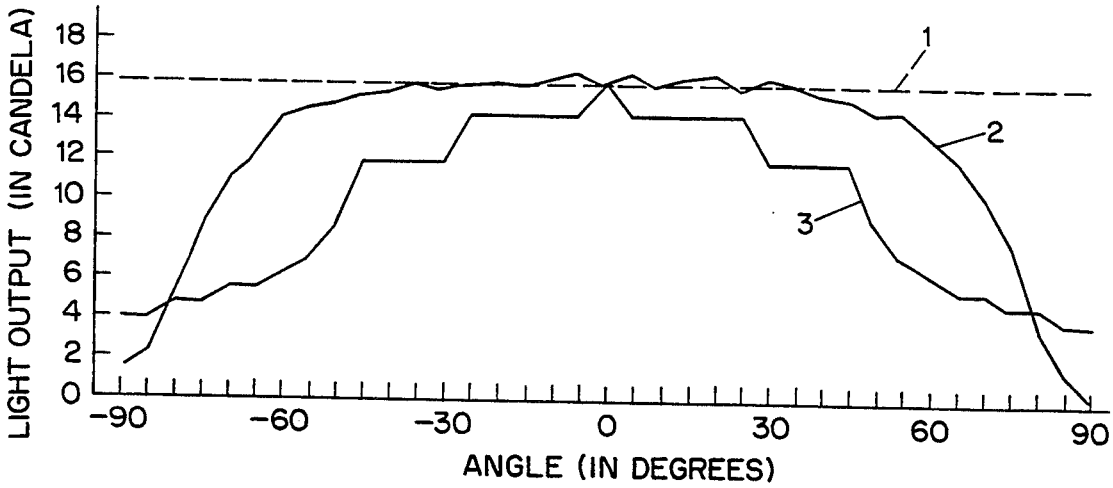
FIG. 7 is a graph, which is described above.
Figure 8:
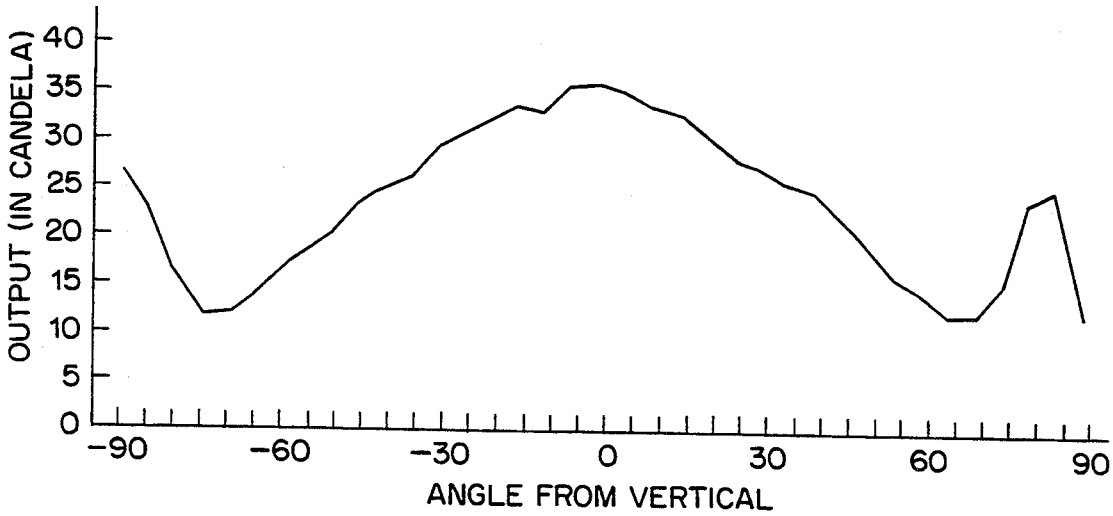
FIG. 8 is a graph, similar to that of FIG. 7, showing the light output in the first reference plane of a strobe light employing the reflector of the present invention.
Figure 9A:
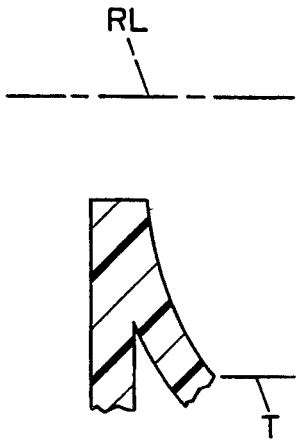
FIGS. 9A to 9G are cross-sectional views taken along the correspondingly lettered lines of FIG. 9.
Figure 9B:
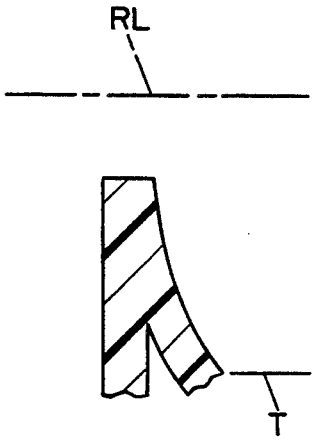
Figure 9C:
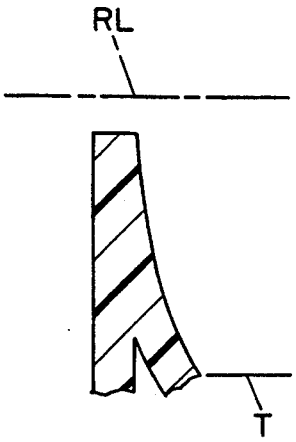
Figure 9D:
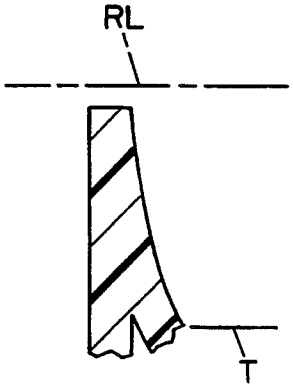
Figure 9E:
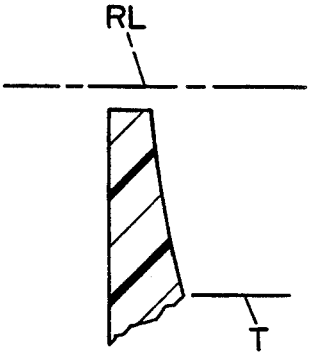
Figure 9F:
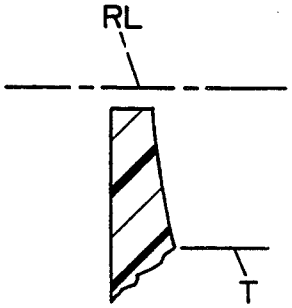
Figure 9G:
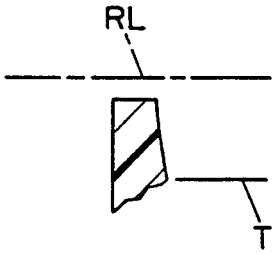

FIG. 8 shows the light output of the light of the above-described embodiment in the plane of the lamp axis, which corresponds to the first reference plane FRP and to the plane of curve 3 for a bare lamp shown in FIG. 7. Up to about 75° + and −, the light output follows the cosine function, but the third surface of the reflector nearly doubles the magnitude in that range. Below about −75° and above about +75°, the output increases markedly. The minimum output is about 11 candles, which comfortably exceeds the minimum outputs established by UL® at angles close to +90° and −90° (curve 3 of FIG. 7), even when the UL® curve is shifted to a maximum output corresponding to a light with a reflector.

I claim:

1. A strobe warning light comprising an elongated strobe lamp having a longitudinal axis, a lamp support supporting the lamp in a predetermined position, and a reflector on the support that includes a first surface positioned on one side of a first reference plane that includes the lamp axis and a second surface spaced apart axially of the lamp from the first surface and positioned on the other side of the first reference plane, the first and second surfaces facing generally toward each other and being configured and oriented to receive light from the lamp and reflect it opposite directions along paths generally parallel to the lamp axis and on opposite sides of the first reference plane so that each one of the first and second surfaces directs reflected light predominantly past the other of the first and second surfaces.

2. A strobe warning light according to claim 1 wherein the first and second surfaces are both located entirely on one side of a second reference plane that includes the lamp axis and is perpendicular to the first reference plane so that the first and second surfaces do not block light from the lamp directed along the second reference plane.

3. A strobe warning light according to claim 1 wherein the first and second surfaces are substantially identical and are located symmetrically with respect to a line in the first plane perpendicular to the lamp axis and intersecting the center of the lamp.

4. A strobe warning light according to claim 3 wherein the first and second surfaces are both located entirely on one side of a second reference plane that includes the lamp axis and is perpendicular to the first reference plane so that the first and second surfaces do not block light from the lamp directed along the second reference plane.

5. A strobe warning light according to claim 3 wherein the first and second surfaces are concavely curved in directions parallel to the first reference plane and in directions parallel to a second reference plane that includes the lamp axis and is perpendicular to the first reference plane such that they reflect light within predetermined angles with respect to the lamp axis in planes parallel to the first reference plane and within predetermined angles with respect to the lamp axis in planes parallel to the second reference plane.

6. A strobe warning light according to claim 5 wherein the reflector further includes a third surface located laterally of the lamp and configured and oriented to reflect light from the lamp in divergent directions generally radially with respect to the lamp axis.

7. A strobe warning light according to claim 6 wherein the third surface is located entirely on one side of a second reference plane that includes the lamp axis and is perpendicular to the first reference plane so that the third surface does not block light from the lamp directed along the second reference plane.

8. A strobe warning light according to claim 7 wherein the first and second surfaces adjoin the third surface.

9. A strobe warning light according to claim 1 wherein the reflector further includes a third surface located laterally of the lamp and configured and oriented to reflect light from the lamp in divergent directions generally radially with respect to the lamp axis.

10. A strobe warning light according to claim 9 wherein in the third surface is a segment of a cylindrical surface that is concave with respect to the axis of the lamp and has its axis substantially parallel to the axis of the lamp.

11. A strobe warning light according to claim 10 wherein the third surface is located entirely on one side of a second reference plane that includes the lamp axis and is perpendicular to the first 12. A strobe warning light according to claim 11 wherein the third surface is a segment of a cylindrical surface that is concave with respect to the axis of the lamp and has its axis substantially parallel to the axis of the lamp.

* * * * *

UNITED STATES PATENT AND TRADEMARK OFFICE

CERTIFICATE OF CORRECTION

PATENT NO. : 5,347,259

DATED : Sep. 13, 1994

INVENTOR(S) : Mark P. Jongewaard

It is certified that error appears in the above-indentified patent and that said Letters Patent is hereby corrected as shown below:

Column 6, line 52, after "first" insert --reference plane so that the third surface does not block light from the lamp directed along the second reference plane.--

Signed and Sealed this

Thirtieth Day of May, 1995

Bruce Lehman

*Attest:*

BRUCE LEHMAN

*Attesting Officer*

*Commissioner of Patents and Trademarks*